US011052515B2

(12) United States Patent
Tillman et al.

(10) Patent No.: US 11,052,515 B2
(45) Date of Patent: Jul. 6, 2021

(54) 90 DEGREE SOCKET ADAPTER

(71) Applicants: Cornelius Tillman, Melbourne, FL (US); Melvin Summers, Jr., Melbourne, FL (US)

(72) Inventors: Cornelius Tillman, Melbourne, FL (US); Melvin Summers, Jr., Melbourne, FL (US)

( * ) Notice: Subject to any disclaimer, the term of this patent is extended or adjusted under 35 U.S.C. 154(b) by 302 days.

(21) Appl. No.: 16/378,538

(22) Filed: Apr. 15, 2019

(65) Prior Publication Data

US 2020/0324395 A1 Oct. 15, 2020

(51) Int. Cl.
*B25B 13/48* (2006.01)
*B25B 23/00* (2006.01)
*B25B 17/00* (2006.01)

(52) U.S. Cl.
CPC ..... *B25B 13/481* (2013.01); *B25B 17/00* (2013.01); *B25B 23/0035* (2013.01)

(58) Field of Classification Search
CPC .... B25B 13/481; B25B 17/00; B25B 23/0035
USPC ..... 81/57.13, 57.29
See application file for complete search history.

(56) References Cited

U.S. PATENT DOCUMENTS 4,920,832 A * 5/1990 Van Gennep ..... B25B 13/481 81/57.29
6,009,776 A * 1/2000 Warren ..... B25B 13/467 81/57.13
6,216,562 B1 * 4/2001 Hsieh ..... B25B 17/00 81/57.29
7,395,738 B1 * 7/2008 Nelson ..... B25B 13/46 81/57.29
2014/0190315 A1 * 7/2014 Kiser ..... B25B 13/481 81/57.29

* cited by examiner

*Primary Examiner* — David B. Thomas
(74) *Attorney, Agent, or Firm* — Cornelius Tillman; Melvin Summers, Jr.

(57) ABSTRACT

The 90 Degrees utilizes dual ratio constant mesh gears which provides suitable use for ratchets in hard to access spaces, and particularly well suited for automotive use. The mesh gears are configured to be used either with manual or pneumatic tools. A female socket element recedes into the housing having gears therein and a male socket element meshes with the female socket element and is shaped to accommodate a female socket element at 90 degrees or the adapter element of a drive ratchet. You can use an elongated drive shaft to accommodate distance. Positioned within the housing of the adapter body are gears secured to mesh within the housing of the adapter. Rotation of the female socket element by a drive ratchet in one direction will rotate the male socket element in the opposite direction without any change in direction is governed by the ratchet use.

1 Claim, 1 Drawing Sheet

Cut Away View

90° Gear Mesh Adapter

Cut Away View

Top Side View

Side View

Bottom Side View

90 DEGREE SOCKET ADAPTER

SUMMARY OF THE INVENTION

This invention relates to a 90 degree mesh gear adapter which has a special utility in permitting the removal of nuts and bolts in confined or difficult to access spaces.

In various kinds of maintenance and repair operations, it is often necessary to remove a nut or bolts from confined areas. In some instances, it is very difficult, if not impossible, for a mechanic to manipulate a tool in the removal of a nut or bolt.

It is therefore an objective of this invention to provide a novel 90 degree gear mesh adapter, of simple and inexpensive construction, which is adaptable for use in removing nuts, bolts and the like from difficult to access areas.

More specifically, the novel 90 degree gear mesh adapter includes a pair of mesh gears driven by a female socket element attached to the housing in which the female socket element, utilizes a drive ratchet assembly to turn both male and female elements.

These and other objectives and advantages of this invention will more fully appear from the following description made in connection with the accompanying drawings, wherein like reference characters refer to the same or similar parts throughout the several views.

FIGURES OF THE DRAWING

DESCRIPTION OF THE PREFERRED EMBODIMENT OF THE INVENTION

Figure 1:
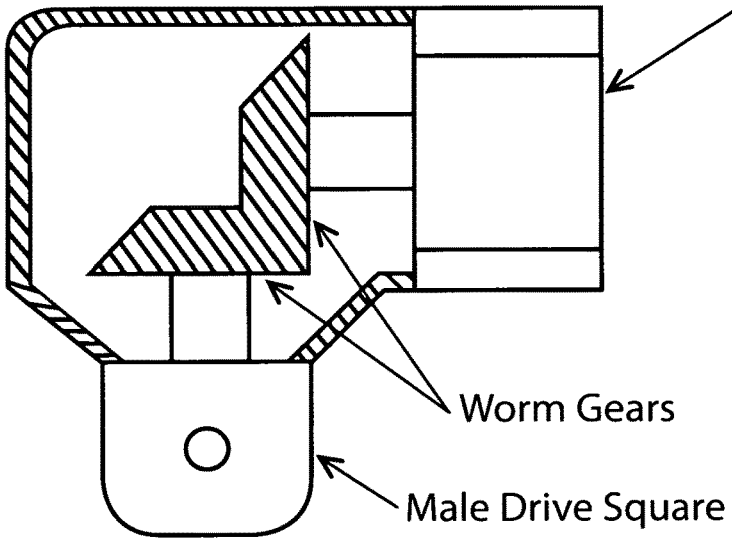
FIG. 1 is a cut away view of the 90 degree gear mesh adapter.

Referring to the drawings and more particularly to FIG. 1, it will be seen that one embodiment of my 90 degree gear mesh adapter includes a body comprised of one cast body section. The body section includes a generally cylindrical 90 degree portion having a generally cylindrical 90 degree housing integrally formed therewith at both ends thereof. The housing includes an end wall and an annular wall. The housing is also provided with an opening opposite the end wall. Similarly, the housing at the male drive square end is provided with an inner wall an annular wall and has an opening opposite the end wall. It will be noted that the openings are at 90 degrees. In FIG. 1 it will be seen that the mesh gears are attached within the housing as worm gears that mesh with the male drive square known as the male drive element in the housing and meshes with the male drive square known as the male drive element in the housing and meshes with the female socket drive square known as the female element in the housing. The 90 degree gear mesh adapter is the male socket element which is described as the male drive square in FIG. 1 of the cut away view configuration being mounted in the housing. The male socket element includes a cylindrical portion which is journaled in the assembly mounted in the associated housing adjacent the openings therein. In this regard, it will be noted that the male socket element projects outwardly from its associated housing, and it will further be noted that the male socket element projects in a 90 degree direction with respect to the female element. A suitable seal is provided with male socket element and engages the cylindrical portion thereof adjacent to the assembly. Retaining rings are provided each engaging the mesh gear assembly within the associated housing to hold them in place. The female socket element as is the male socket element is provided with a worm gear positioned within the associated housing and disposed in meshing relation as described in FIG. 1. In this regard, the worm gear on the male socket element is disposed in meshing relation for the worm gear on the shaft section while the worm gear on the female socket element is disposed in meshing relation with the worm gear on the shaft section. The male socket element is also provided with a shaft which projects axially from the associated worm gear and engages in a seat for properly positioning the male socket element and the associated worm gear for proper meshing relation with the worm gear on the drive shaft. Said housing is provided with a bore therein which is disposed in relation with respect to the vertical and horizontal axis of the associated seat portion of the male and female element. Each bore accommodates an end socket member female and male respectively therein. In this regard, the end socket member which is of cubical configuration. The female socket element is provided with a socket recess which is of cubical configuration. The female socket drive square on the 90 degree gear mesh adapter receives a conventional ratchet driver thus transferring it's movement to the male drive square in FIG. 1.

Figure 2:
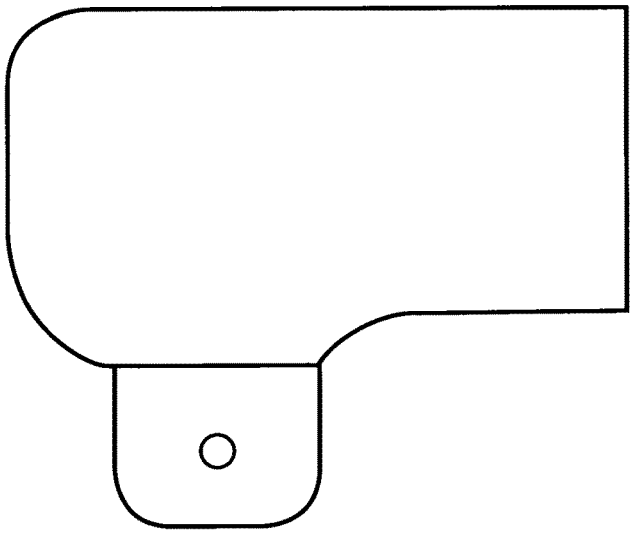
FIG. 2 is a side view of the 90 degree gear mesh adapter.

Referring to FIG. 2 which is a side view of the 90 degree gear mesh adapter which has a locking ball on the male drive square that fits conventional sockets.

Figure 3:
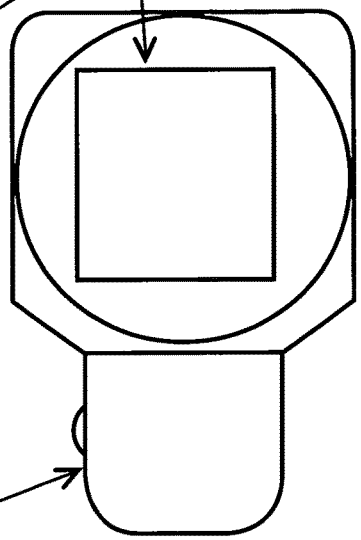
FIG. 3 is a top side view of the 90 degree gear mesh adapter.

Referring to FIG. 3 which is a top view of the 90 degree gear mesh adapter which pictures the female element that receives a conventional ratchet driver.

Figure 4:
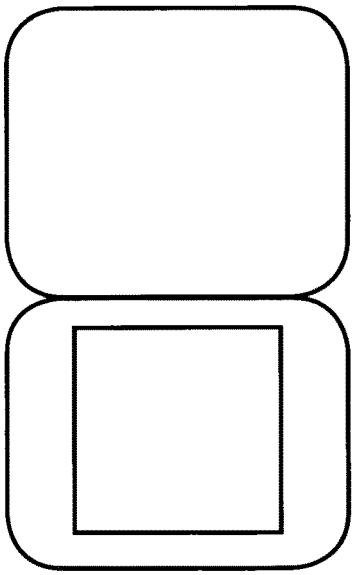
FIG. 4 is a bottom side view of the 90 degree gear mesh gear adapter

Referring to FIG. 4 which is a bottom side view of the 90 degree gear mesh adapter which shows the male drive square and the locking ball protruding from the male drive square and the female socket drive square risen at 90 degrees.

It will therefore be seen from the foregoing paragraphs that the 90 degree gear mesh adapter, which is not only of simple and inexpensive construction, but one which functions in a more efficient manner than any known comparable devices.

It is anticipated that various changes can be made in the size, shape and construction of the 90 degree gear mesh adapter device disclosed herein without departing from the spirit and scope of the invention as defined by the following claims.

We claim:

1. A 90 degree adapter comprising: (a) male drive square that has a shaft for stability inside the housing unit (b) a housing unit that contains the worm gear and shaft (c) a retaining ring for both male and female socket drive squares (d) two worm gear that are retained by retaining rings at the housing (e) a male drive square that has a shaft between the worm gear and housing (f) the two worm gears positioned at 90 degrees inside of the housing (g) a female socket drive square that is held inside the housing by a retaining ring (h) a male drive square that is held in the housing by a retaining ring (i) the female worm gear being aligned in such a manner that the male drive square shaft prevents it from moving in an unstable way (j) a male socket drive square that rotates outside of the housing unit and a female socket drive square that rotates inside of the housing unit while being locked to the housing unit by retaining rings (k) two worm gears that are aligned at 90 degrees within the housing unit (1) the female worm gear being aligned in such a manner that the male drive square shaft prevents it from moving in a unstable way (m) worm gears that move in opposite directions when a drive socket or socket extension is used (n) a female socket drive square that has a shaft between the worm gear and the housing.

* * * * *